US006536340B2

(12) United States Patent
Nakamura

(10) Patent No.: US 6,536,340 B2
(45) Date of Patent: Mar. 25, 2003

(54) SHEET-FED ROTARY PRINTING PRESS WITH CONVERTIBLE MECHANISM

(75) Inventor: Yuichi Nakamura, Ibaraki (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/895,497

(22) Filed: Jun. 29, 2001

(65) Prior Publication Data

US 2002/0000166 A1 Jan. 3, 2002

(30) Foreign Application Priority Data

Jun. 29, 2000 (JP) ..... 2000-195620

(51) Int. Cl.[7] ..... B41F 5/02; B41F 21/10

(52) U.S. Cl. ..... 101/230; 101/246; 101/409; 271/277

(58) Field of Search ..... 101/229, 230, 101/231, 232, 246, 408, 409, 410; 271/275, 277

(56) References Cited

U.S. PATENT DOCUMENTS 3,944,218 A * 3/1976 Cerny ..... 101/230
4,823,695 A 4/1989 Kida ..... 101/230
5,186,108 A * 2/1993 Hillebrand ..... 101/415.1

FOREIGN PATENT DOCUMENTS

DE 3517115 A1 1/1986
DE 19547580 A1 6/1997

* cited by examiner

*Primary Examiner*—Andrew H. Hirshfeld
*Assistant Examiner*—Jill E Culler
(74) *Attorney, Agent, or Firm*—Blakely Sokoloff Taylor & Zafman

(57) ABSTRACT

A sheet-fed rotary printing press with a convertible mechanism includes a convertible cylinder, a plurality of gripper units, a plurality of holding members, a convey mechanism, and a pair of paper guide members. The convertible cylinder conveys a sheet. The gripper units are arranged on an outer surface of the convertible cylinder and lined up in an axial direction of the convertible cylinder, and grip the sheet. The holding members are arranged on the outer surface of the convertible cylinder to be adjacent to the gripper units, and lined up in the axial direction of the convertible cylinder to be phase-shifted from the gripper units. In single-sided printing, the convey mechanism conveys the sheet fed from an upstream convey cylinder by gripping its leading edge upon opening/closing operation of the gripper units. In double-sided printing, the convey mechanism holds a trailing edge of the sheet, fed from the upstream convey cylinder, with the holding members and thereafter gripping-changes the sheet to the gripping units. The pair of paper guide members are arranged at at least one of a position between the holding members and an outermost position outside the second gripper units, and guide two sides of the sheet conveyed by the holding members to corresponding ones of the gripper units.

8 Claims, 4 Drawing Sheets

SHEET-FED ROTARY PRINTING PRESS WITH CONVERTIBLE MECHANISM

BACKGROUND OF THE INVENTION

The present invention relates to a sheet-fed rotary printing press with a convertible mechanism, which performs switching between single-sided printing and double-sided printing by using a convertible cylinder with a gripper unit and holding member on its outer surface.

In general, a sheet-fed rotary printing press with a convertible mechanism has a convertible cylinder, and a gripper unit comprised of a plurality of pairs of grippers and gripper pads, and a holding member are provided to the outer surface of the convertible cylinder. U.S. Pat. No. 4,823,695 discloses a three-cylinder-type sheet-fed rotary printing press with a sheet turn-over apparatus or convertible mechanism, which has a transfer cylinder, a turn-over or convertible cylinder, and a double-diameter cylinder between them. This printing press will be described in detail. The turn-over cylinder has a plurality of grippers (A) for gripping the leading edge of a sheet fed from the double-diameter cylinder during single-sided printing to allow conveyance, and a plurality of grippers (B) for holding the trailing edge of the sheet fed from the double-diameter cylinder and performing gripping change of the sheet to the grippers (A) during double-sided printing.

In this arrangement, during double-sided printing, the trailing edge of the sheet gripped by the grippers of the upstream double-diameter cylinder is gripped by the grippers (B) of the turn-over cylinder when it is located at a position opposing the convertible cylinder. Simultaneously, the grippers of the double-diameter cylinder are opened, so the sheet is transferred to the turn-over cylinder. Subsequently, the grippers (B) and (A) of the turn-over cylinder move such that their gripper ends become close to each other, and open and close at momentary different timings, so the trailing edge of the sheet is gripping-changed from the grippers (B) to the grippers (A). Then, the grippers (A) and (B) move in the opposite directions to reverse the sheet gripped by the grippers (A). When the trailing edge of the sheet is located at a position opposing a downstream impression cylinder, the sheet is gripping-changed from the grippers (A) to the grippers of the downstream impression cylinder. After that, the lower surface of the sheet is printed by a downstream printing unit.

In the conventional sheet-fed rotary printing press with the convertible mechanism, the plurality of grippers (B) are arranged almost equidistantly in the axial direction. However, as the widthwise sizes of the sheets sometimes differ depending on the sheet sizes, the two sides of the sheet do not correspond to the positions of the grippers (B), and are not gripped by the grippers (B).

In this case, as the grippers (B) and (A) rotate along loci with small radii of curvature, sometimes gripping change cannot be performed. When gripping change is to be performed from the grippers (B) to the grippers (A), as the peripheral velocity of the grippers (B) is fast, the two sides of the sheet which are not gripped by the grippers (B) flutter as if they wave. Due to this fluttering, the two sides of the sheet are not smoothly guided to the grippers (A), and the sheet cannot be gripping-changed to the grippers (A). Also, the leading edge portions of the two sides of the sheet abut against the grippers (A), and accordingly the corner of the sheet is bent, or a registration error occurs.

SUMMARY OF THE INVENTION

It is an object of the present invention to provide a sheet-fed rotary printing press with a convertible mechanism, which can transfer a sheet reliably.

It is another object of the present invention to provide a sheet-fed rotary printing press with a convertible mechanism, in which damage to the sheet is prevented.

It is still another object of the present invention to provide a sheet-fed rotary printing press with a convertible mechanism, in which a registration error is prevented.

In order to achieve the above objects, according to the present invention, there is provided a sheet-fed rotary printing press with a convertible mechanism, comprising a convertible cylinder for conveying a sheet-like object, a plurality of first gripper units arranged on an outer surface of the convertible cylinder and lined up in an axial direction of the convertible cylinder, and adapted to grip the sheet-like object, a plurality of holding members arranged on the outer surface of the convertible cylinder to be adjacent to the first gripper units, and lined up in the axial direction of the convertible cylinder to be phase-shifted from the first gripper units, a convey mechanism which, in single-sided printing, conveys the sheet-like object fed from an upstream convey cylinder by gripping a leading edge thereof upon opening/closing operation of the first gripper units, and in double-sided printing, holds a trailing edge of the sheet-like object fed, from the upstream convey cylinder, with the holding members and thereafter gripping-changes the sheet-like object to the first gripping units, and a pair of guide members arranged at at least one of a position between the holding members and an outermost position outside the holding members, and adapted to guide two sides of the sheet-like object conveyed by the holding members to corresponding ones of the first gripper units.

DESCRIPTION OF THE PREFERRED EMBODIMENT

The present invention will be described in detail with reference to the accompanying drawings.

Figure 3:
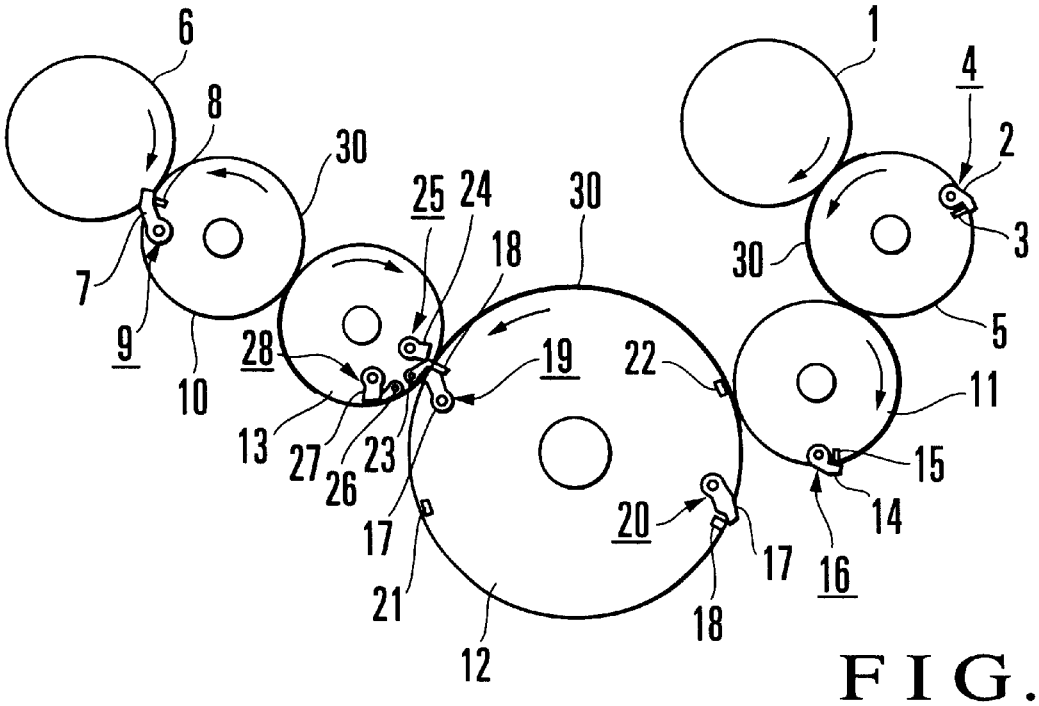
FIG. 3 is a view showing single-sided printing operation in a sheet-fed rotary printing press with a convertible mechanism according to an embodiment of the present invention.
Figure 4:
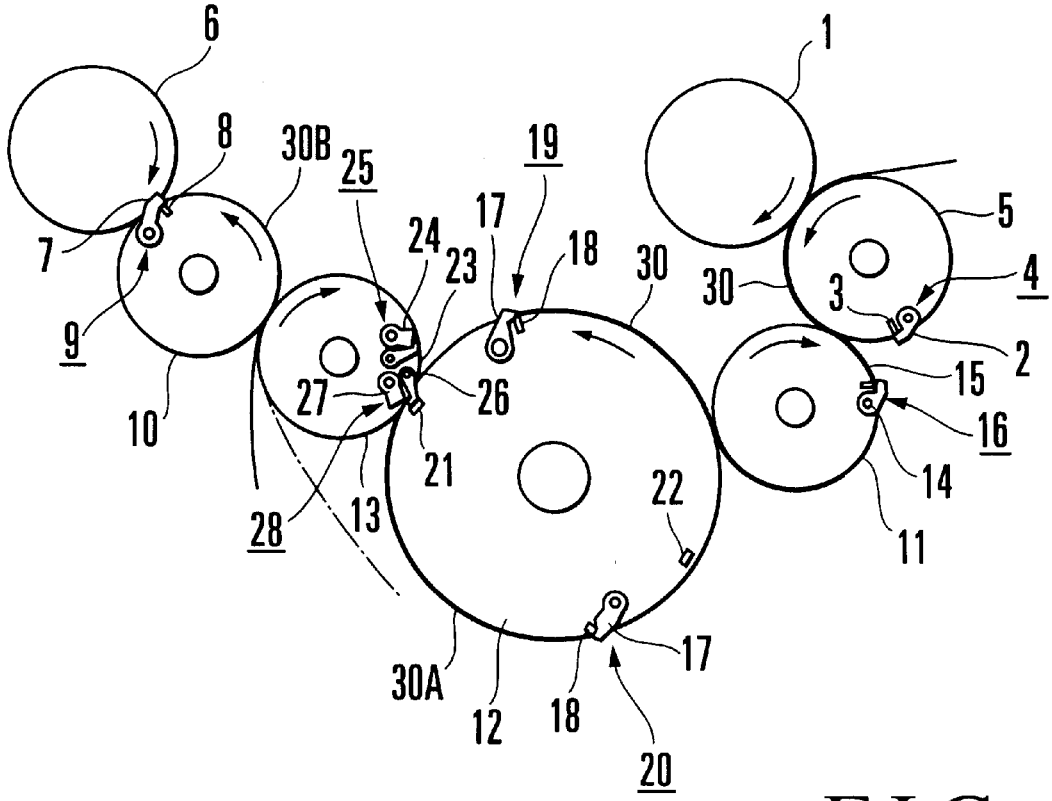
FIG. 4 is a view showing double-sided printing operation in the sheet-fed rotary printing press with the convertible mechanism according to the embodiment of the present invention.

FIGS. 3 and 4 show the schematic arrangement of a sheet-fed rotary printing press with a convertible mechanism according to an embodiment of the present invention. Single-sided printing (FIG. 3) and double-sided printing (FIG. 4) will be described first.

Referring to FIG. 3, in an upstream printing unit, a blanket cylinder 1 in contact opposite to an upstream plate cylinder (not shown), and an impression cylinder 5 in contact opposite to the blanket cylinder 1 and having a gripper unit 4 comprised of a plurality of grippers 2 and gripper pads 3 in a notch in its outer surface are disposed. In a downstream printing unit, a blanket cylinder 6 in contact opposite to a downstream plate cylinder (not shown), and an impression cylinder 10 in contact opposite to the blanket cylinder 6 and having a gripper unit 9 comprised of a plurality of grippers 7 and gripper pads 8 are similarly disposed.

A transfer cylinder 11, double-diameter cylinder 12, and convertible cylinder 13 are arranged between the impression cylinders 5 and 10 such that their outer surfaces are in sequential contact to each other. A gripper unit 16 comprised of a plurality of sets of grippers 14 and gripper pads 15 is disposed in the notch (not shown) in the outer surface of the transfer cylinder 11. Two gripper units 19 and 20 each comprised of a plurality of sets of grippers 17 and gripper pads 18 are disposed at positions that equally halve the outer surface of the double-diameter cylinder 12. Suction heads 21 and 22 are disposed at positions more downstream in the rotating direction of the cylinder of the gripper units 19 and 20. The plurality of suction heads 21 and 22 are lined up on the outer surface of the double-diameter cylinder 12 in the axial direction, and are supported to be movable in the circumferential direction of the double-diameter cylinder 12. When the double-diameter cylinder 12 moves in the circumferential direction, the phases of the suction heads 21 and 22 are adjusted in the circumferential direction with respect to the gripper units 19 and 20.

Figure 2:
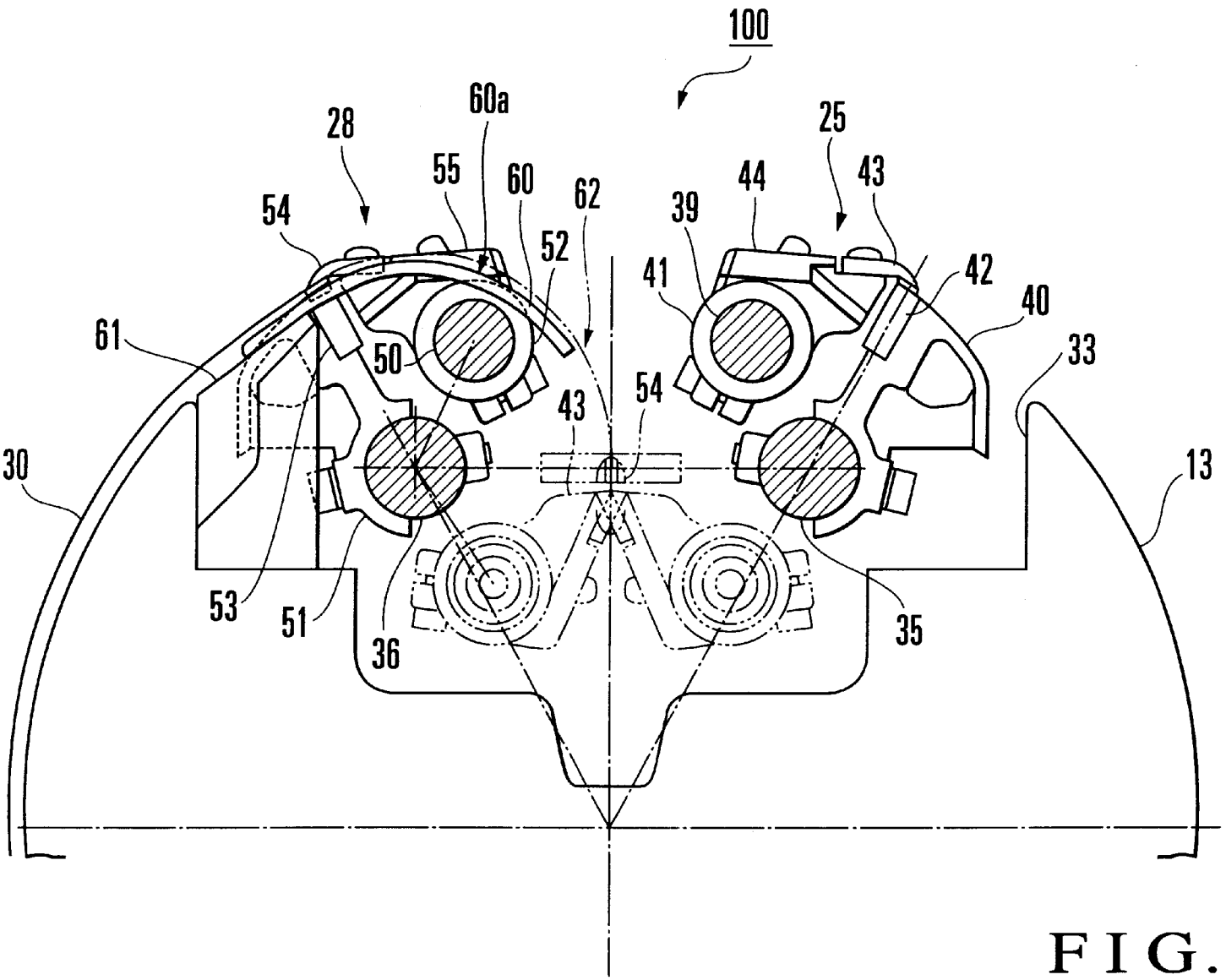
FIG. 2 is a sectional view taken along the line II—II of FIG. 1.

In an outer-surface notch 33 of the convertible cylinder 13, as shown in FIG. 2, a gripper unit 25 comprised of a plurality of sets of grippers 23 and gripper pads 24 and a gripper unit 28 comprised of a plurality of sets of grippers 26 and gripper pads 27 are disposed to be adjacent to each other in the circumferential direction. The cylinders 1, 5, 11, 12, 13, 10, and 6 are operatively connected to each other through gears. A pivot gear movable in the axial direction is formed on the end shaft of the convertible cylinder 13 such that it can be fixed to and opened from a stationary gear fixed to the shaft. The stationary gear meshes with the gear of the impression cylinder 10, and the pivot gear meshes with the gear of the double-diameter cylinder 12.

In the printing press with the above arrangement, when single-sided printing shown in FIG. 3 is to be performed, the respective cylinders rotate in the directions of arrows, so a sheet 30 fed from a sheet feeder (not shown) is gripped by the gripper unit 4 of the impression cylinder 5 through a swing unit (not shown). The sheet 30 gripped by the gripper unit 4 is gripping-changed to the gripper unit 16 of the transfer cylinder 11 and conveyed. At this time, when the sheet 30 passes between the blanket cylinder 1 and impression cylinder 5, the first color is printed on it. Then, after the sheet 30 is gripping-changed from the gripper unit 16 of the transfer cylinder 11 to the gripper unit 20 (19) of the double-diameter cylinder 12 and conveyed, it is gripping-changed to the gripper unit 25 opposing the gripper unit 20 and is conveyed. Then, after the sheet 30 is gripped by the gripper unit 9 of the impression cylinder 10 and conveyed, when it passes between the blanket cylinder 6 and impression cylinder 10, the second color is printed on it on the same upper surface where the first color has been printed.

When single-sided printing is to be shifted to double-sided printing, in the state wherein the gripper units 20 and 25 oppose each other, the pivot gear (not shown) is pivoted such that the suction heads 21 and gripper unit 28 oppose each other, as shown in FIG. 4, and the upstream cylinder group including the double-diameter cylinder 12 is phase-adjusted with respect to the convertible cylinder 13. Subsequently, the phases of the gripper units 19 and 20 on the double-diameter cylinder 12 and those of the suction heads 21 and 22 relative to each other are adjusted to cope with a change in sheet size. After this switching adjustment is performed, when the respective cylinders are rotated in the direction of arrows, the sheet 30 gripped by the gripper unit 4 of the impression cylinder 5 is printed at its upper surface while it passes between the blanket cylinder 1 and impression cylinder 5. After printing, the sheet 30 is gripping-changed from the gripper unit 4 of the impression cylinder 5 to the gripper unit 16 of the transfer cylinder 11, and is conveyed.

Subsequently, the leading edge of the sheet 30 is gripping-changed from the gripper unit 16 of the transfer cylinder 11 to the gripper unit 19 (20) of the double-diameter cylinder 12, and the trailing edge thereof is attracted by the suction heads 21 (22), so the sheet 30 is conveyed. At this time, a sheet 30A is wound around the double-diameter cylinder 12. When the trailing edge of the sheet 30 reaches a contact point of the double-diameter cylinder 12 with respect to the convertible cylinder 13 and the suction heads 21 (22) and the gripper unit 28 oppose each other, supply of the suction air to the suction heads 21 (22) is disconnected. Simultaneously, the gripper unit 28 is closed, so the drawn trailing edge of the sheet 30 is released and is gripped by the gripper unit 28.

After that, when the sheet 30 is conveyed to the impression cylinder 10 while being gripped by the gripper unit 28, the gripper ends of the gripper unit 28 and gripper unit 9 are directed in opposite directions, and gripping change cannot be performed. For this reason, while being gripped by the gripper unit 28 and conveyed, the sheet 30 is gripping-changed to the gripper unit 25 the gripper end direction of which is opposite to that of the gripper unit 28, and is conveyed. A sheet 30B, which has been conveyed in this manner while being converted such that it is turned over, is gripping-changed to the gripper unit 9 of the impression cylinder 10, and is conveyed. When the sheet 30B passes between the blanket cylinder 6 and impression cylinder 10, its lower surface comes in contact opposite to the blanket cylinder 6 so it is printed. Thus, double-sided printing can be performed as well as upper-side printing.

The structure of the gripper units 25 and 28 which perform gripping change of the sheet 30 will be described with reference to FIGS. 1 and 2. Two end shafts 32 of the convertible cylinder 13 are axially supported by a pair of frames 31 through bearings (not shown). The notch 33 is formed in the outer surface of the convertible cylinder 13 to extend in the axial direction, and the gripper units 25 and 28 described above are accommodated in the notch 33.

A gripper pad shaft 35 for the gripper unit 25 extends parallel to the convertible cylinder 13 by its overall length, and is pivotally and axially supported by a bracket (not shown) through a gripper pad bearing (not shown). A pair of gripper shaft holders 38 are fixed to the two ends of the gripper pad shaft 35, and a hollow gripper shaft 39 is pivotally and axially supported by the pair of gripper shaft holders 38. In the gripper unit 25, the plurality of gripper pads 27 on the gripper pad shaft 35 and the plurality of grippers 26 on the gripper shaft 39 form pairs that are lined up in the axial direction of the convertible cylinder 13.

More specifically, the gripper unit 25 has a plurality of gripper pad holders 40 fixed to the gripper pad shaft 35 at a predetermined interval, and a plurality of gripper holders 41 corresponding to the gripper pad holders 40 and fixed to the gripper shaft 39 by split fastening. A gripper pad 42 is fixed to each gripper pad holder 40, and a gripper 43 is mounted on each gripper holder 41 through a contact pressure adjustment spring member 44. When the gripper holder 41 is pivoted by an opening/closing mechanism (not shown), the corresponding gripper 43 opens/closes with respect to the corresponding gripper pad 42.

A gripper pad shaft 36 for the gripper unit 28 extends parallel to the convertible cylinder 13 by its overall length, and is pivotally and axially supported by a bracket (not shown) through a gripper pad bearing (not shown). A gripper shaft 50 for the gripper unit 28 is pivotally and axially supported by gripper shaft holders (not shown) fixed to the two ends of the gripper pad shaft 36. In the gripper unit 28, a plurality of gripper pads 53 on the gripper pad shaft 36 and a plurality of grippers 54 on the gripper shaft 50 form pairs that are lined up in the axial direction of the convertible cylinder 13.

More specifically, the gripper unit 28 has a plurality of gripper pad holders 51 fixed to the gripper pad shaft 36 at a predetermined interval, and a plurality of gripper holders 52 corresponding to the gripper pad holders 51 and fixed to the gripper shaft 50 by split fastening. Each gripper pad 53 is fixed to the corresponding gripper pad holder 51, and each gripper 54 is mounted on the corresponding gripper holder 52 through a contact pressure adjustment spring member 55. When the gripper holder 52 is pivoted by an opening/closing mechanism (not shown), the corresponding gripper 54 opens/closes with respect to the corresponding gripper pad 53.

Figure 1:
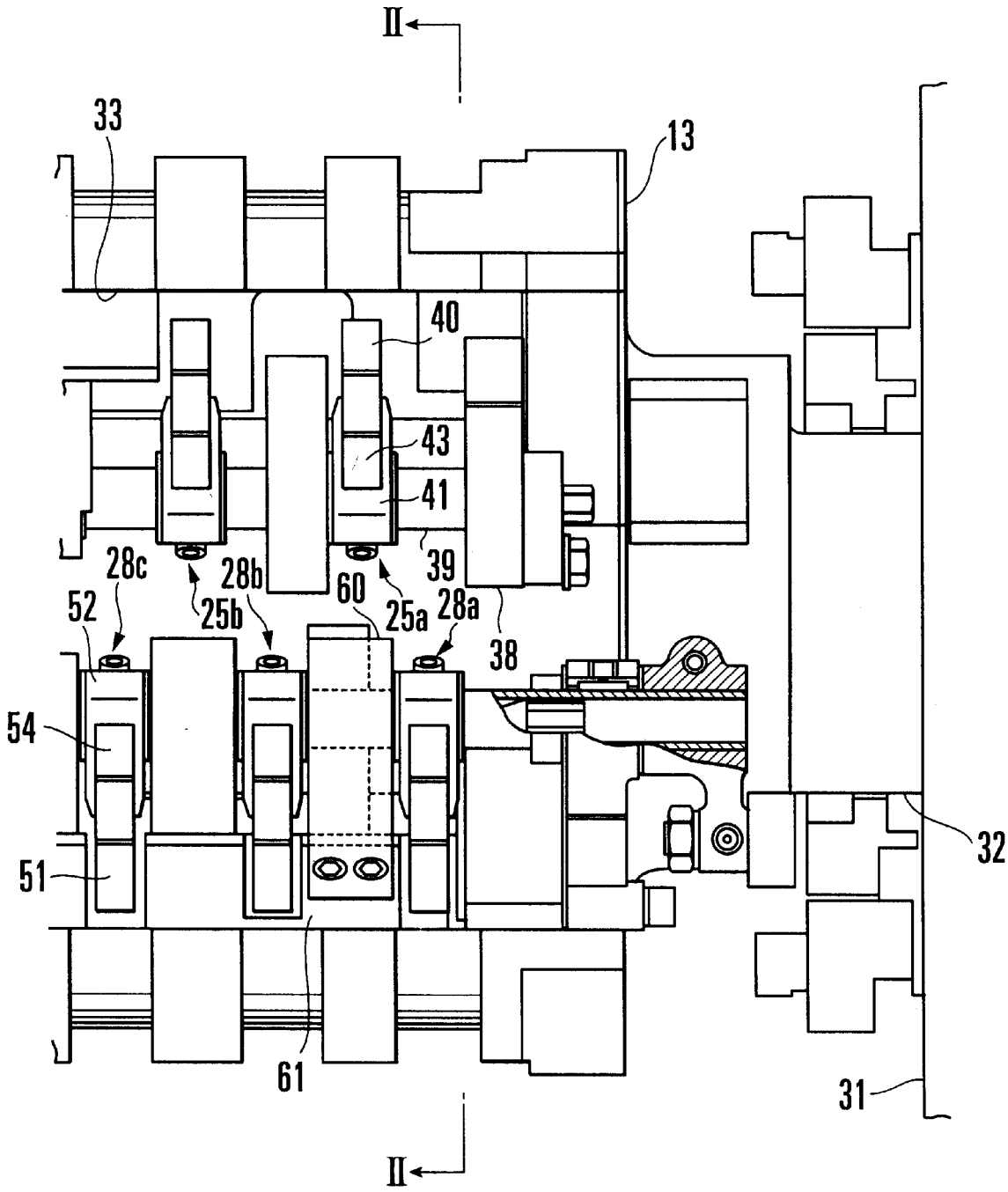
FIG. 1 is a plan view showing the main part of a convertible cylinder in the sheet-fed rotary printing press with a convertible mechanism shown in FIGS. 3 and 4.

As shown in FIG. 1, the gripper pad holders 40, gripper holders 41, gripper pads 42, and grippers 43 of the gripper unit 25 constitute gripper units 25*a, 25b,* . . . , and the gripper pad holders 51, gripper holders 52, gripper pads 53, and grippers 54 of the gripper unit 28 constitute gripper units 28*a, 28b, 28c,* . . .

As shown in reference 1, each of the gripper units 25 and 28 formed in the above is provided with a convertible mechanism (not shown) which move the entire assembly about the gripper pad shaft 35 or 36 as the pivot center, and the opening/closing mechanism (not shown) for opening/closing the gripper 43 or 54 from the gripper pad 42 or 53 about the gripper shaft 39 or 50 as the center. The gripper units 25 and 28, grippers 43 and 54, the convertible mechanisms, and the opening/closing mechanisms constitute a convey mechanism 100 which is switched for single-sided printing and double-sided printing so as to convey the sheet 30.

As shown in FIG. 1, the gripper units of the gripper units 25 and 28 are arranged to be phase-shifted from each other in the axial direction of the convertible cylinder 13. More specifically, the gripper units 25*a, 25b,* . . . of the gripper unit 25 are arranged between the gripper units 28*a, 28b, 28c,* . . . of the gripper unit 28. No gripper units of the gripper unit 25 are arranged outside the gripper units 28*a* (28*n*) located at two ends of the convertible cylinder 13.

In the printing press with the above arrangement, as shown in FIG. 4, when the suction heads 21 of the double-diameter cylinder 12 and the gripper unit 28 of the convertible cylinder 13 opposes each other, the gripper unit 28 is opened/closed by the opening/closing mechanisms (not shown) to gripping-change the trailing edge of the sheet 30 from the suction heads 21. When the cylinders further rotate, the gripper units 25 and 28 are pivoted by the convertible mechanisms (not shown) about the gripper shafts 39 and 50 as the pivot centers to come close to each other. When the cylinders further rotate, the gripper units 25 and 28 are opened/closed by the opening/closing mechanisms at momentary different timings, so the trailing edge of the sheet 30 is gripping-changed from the gripper unit 28 to the gripper unit 25.

When the cylinders further rotate, the gripper units 25 and 28 are converted in opposite directions by the convertible mechanisms, and are restored to the initial state. When the cylinders further continue rotation and the gripper unit 25 and the gripper unit 9 of the impression cylinder 10 oppose each other, the trailing edge of the sheet 30 is gripping-changed to the gripper unit 9, in the same manner as in single-sided printing.

As shown in FIG. 1, a pair of paper guide members 60 are disposed between, of the plurality of gripper units constituting the gripper unit 28, the outermost gripper units 28*a* and 28*n* corresponding to the two ends of the convertible cylinder 13 and the gripper units 28*b* and 28*m* adjacent to the gripper units 28*a* and 28*n* on the inner side. The paper guide members 60 are fixed to the side walls of the notch 33, formed in the convertible cylinder 13, through brackets 61. As shown in FIG. 2, the upper surfaces of the paper guide members 60 form guide surfaces 60a which are arcuate in the sheet convey direction. The arc of each guide surface 60*a* has a curvature substantially equal to that of a locus of rotation 62 of the gripper 54, and a radius of curvature slightly smaller than that of the locus of rotation 62.

Figure 5:
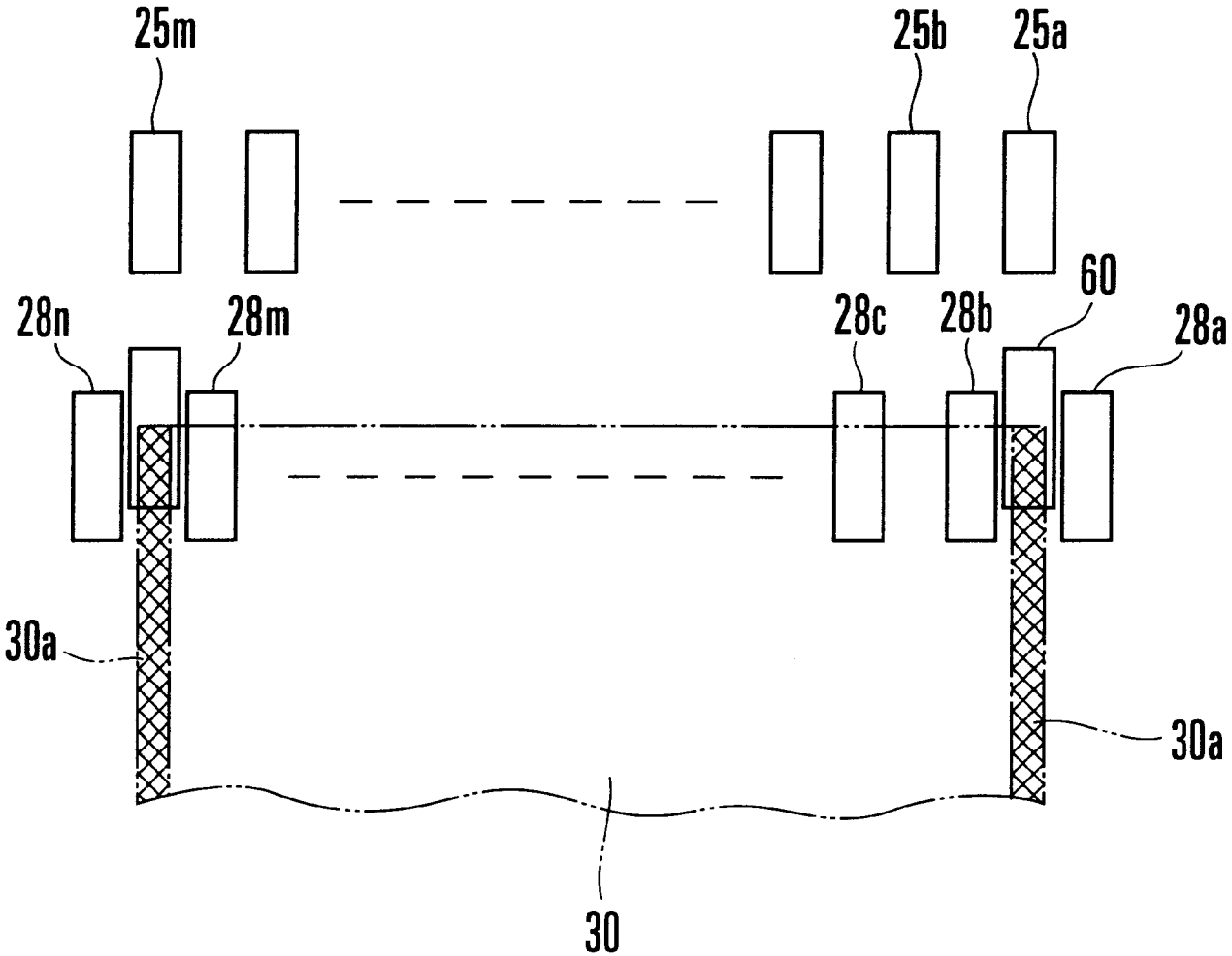
FIG. 5 is a view showing the arrangement of the gripper units and the relationship between a small-sized sheet and paper guide members in the convertible cylinder shown in FIG. 1.

In this arrangement, in double-sided printing, when gripping change is to be performed from the gripper unit 28 to the gripper unit 25, as shown in FIG. 5, even if the sheet 30 has such a size that its two sides 30*a* (hatched portions) are located between the gripper units 28*a* and 28*b* and between the gripper units 28*m* and 28*n* of the gripper unit 28, the sheet 30 is conveyed with its sides 30*a* being in contact with the guide surfaces 60*a* of the paper guide members 60. Accordingly, the two sides 30*a* of the sheet 30 which are not gripped by the gripper units 28*b* and 28*m* do not flutter during convey operation, and the sheet 30 maintains a stable posture. Hence, the sheet 30 is reliably guided by the gripper units 25*a* and 25*m* of the gripper unit 25, so the sheet 30 is transferred smoothly and reliably, and a registration error can be prevented. Also, the corners of the sheet 30 are prevented from coming into contact with the gripper units 25*a* and 25*m,* so they will not be bent or fractured.

In the above embodiment, the trailing edge of the sheet 30 is gripped by the gripper unit 28. Alternatively, in place of the gripper unit 28, suction pads may attract the trailing edge of the sheet 30, thereby holding the sheet 30.

The paper guide members 60 are arranged between the gripper units 28*a* and 28*b* of the gripper unit 28. Depending on the size of the sheet 30, the paper guide members 60 may be arranged between the gripper units 28*b* and 28*c*. It suffices as far as the paper guide members 60 are arranged between gripper units corresponding to the two ends of the sheet 30. Three or more paper guide members 60 may be provided to the gripper unit 28, and the paper guide members 60 may be provided not only on the gripper unit 28 side but also on the gripper unit 25 side.

When the gripper units of the gripper units 25 and 28 are arranged to establish an opposite positional relationship (the outermost gripper units of the gripper unit 25 correspond to the two ends of the convertible cylinder 13), the paper guide members 60 may be arranged outside the gripper units (at positions corresponding to the outermost gripper units of the gripper unit 25) of the gripper unit 28.

The guide surface 60*a* of each paper guide member 60 has a curvature substantially equal to that of the locus of rotation 62 of the gripper 54 and a radius of curvature slightly smaller than that of the locus of rotation 62. However, the present invention is not limited to this. It suffices as far as the guide surfaces 60*a* have such shapes that they can smoothly grip the two sides 30*a* of the sheet 30 which are not gripped by the gripper unit 28 and guide them to the gripper unit 25.

As has been described above, according to the present invention, when a sheet-like object is to be transferred from the holding members to the gripper units, since the two sides of the sheet-like object which are not held by the holding members are guided by the guide members and gripped by the gripper units, the sheet-like object can be transferred smoothly and reliably. Also, fracture and a registration error of the sheet-like object can be prevented.

In addition, even the two sides of a smaller-sized sheet-like object can be guided by the guide members and reliably gripped by the gripper units.

What is claimed is:

1. A sheet-fed rotary printing press with a convertible mechanism, comprising:

a convertible cylinder for conveying a sheet;

a plurality of first gripper units provided on said convertible cylinder and lined up in an axial direction of said convertible cylinder, and adapted to grip the sheet;

a plurality of holding members provided on said convertible cylinder to be adjacent to said first gripper units, and lined up in the axial direction of said convertible cylinder to be phase-shifted from said first gripper units; and a pair of guide members arranged at at least one of a position between said holding members and an outermost position outside said holding members, and adapted to move relative to said holding members to guide two sides of the sheet conveyed by said holding members to said first gripper units, and wherein said first gripper units convey the sheet fed from an upstream convey cylinder by gripping a leading edge thereof in single-sided printing, and said holding members hold a trailing edge of the sheet fed from the upstream convey cylinder to thereafter gripping-change the sheet to said first gripping units.

2. A printing press according to claim 1, wherein said guide members are arranged between said holding members.

3. A printing press according to claim 1, wherein said guide members are arranged between outermost ones of said holding members which are arranged to correspond to two ends of said convertible cylinder, and ones of said holding members which are adjacent inside to said outermost ones of said holding members.

4. A printing press according to claim 1, wherein said holding members are comprised of second gripper units lined up in the axial direction of said convertible cylinder, each of said second gripper units is comprised of a gripper and a gripper pad which grips the sheet in cooperation with said gripper.

5. A printing press according to claim 4, wherein said second gripping units are pivotally supported, and said guide members having guide surfaces arcuate in a sheet convey direction.

6. A printing press according to claim 4, wherein said second gripping units are pivotally supported, and said guide surfaces have a curvature substantially equal to a locus of rotation of said second gripper unit defined by a sheet convey direction upon pivot motion of said second gripper units.

7. A print press according to claim 4, wherein said second gripping units are pivotally supported, and said guide surfaces have a radius of curvature slightly smaller than that of a locus of rotation of said second gripper unit defined by a sheet convey direction upon pivot motion of said second gripper units.

8. A printing press according to claim 1, wherein each of said first gripper units is comprised of a gripper and a gripper pad which grips the sheet in cooperation with said gripper, and is pivotally supported.

* * * * *